United States Patent [19]

Egan et al.

[11] Patent Number: 4,566,820

[45] Date of Patent: Jan. 28, 1986

[54] CATSEYE MOUNTINGS

[76] Inventors: Paul F. Egan, Greensleeves House, Bluebell La., Harescombe, Gloucestershire; William D. Broadfoot, Twin Banks House, Station Rd., Andoversford, Cheltenham, Gloucestershire; Peter Alden, 57 Portland St., Cheltenham, Gloucestershire, all of England

[21] Appl. No.: 563,511

[22] Filed: Dec. 20, 1983

[51] Int. Cl.[4] ..... E01F 9/00

[52] U.S. Cl. ..... 404/14; 350/103

[58] Field of Search ..... 404/9, 12, 13, 14, 72; 350/97, 102, 103

[56] References Cited

U.S. PATENT DOCUMENTS

| | | | |
|---|---|---|---|
| 3,890,054 | 6/1975 | O'Connor | 404/14 |
| 4,152,046 | 5/1979 | Knapp | 350/103 |
| 4,284,365 | 8/1981 | Rabinbow | 404/14 |

FOREIGN PATENT DOCUMENTS

| | | | |
|---|---|---|---|
| 126782 | 6/1931 | Austria | 404/9 |
| 2164272 | 6/1973 | Fed. Rep. of Germany | 404/9 |
| 545039 | 5/1942 | United Kingdom . | |
| 614657 | 12/1948 | United Kingdom . | |
| 1018831 | 2/1966 | United Kingdom . | |
| 1150175 | 4/1969 | United Kingdom . | |
| 1190258 | 4/1970 | United Kingdom . | |
| 2086454 | 5/1982 | United Kingdom | 404/14 |

*Primary Examiner*—James A. Leppink
*Assistant Examiner*—William P. Neuder
*Attorney, Agent, or Firm*—Young & Thompson

[57] ABSTRACT

A "catseye" mounting has a base 2 of circular cross-section enabling it to be mounted readily and securely within a circular hole 9 formed in a road surface using a core-drilling machine. The machine can cut a larger upper recess 8 which receives a rim 3 of the mounting. A passageway 10 allows adhesive material to be injected into the narrow space between the mounting and the hole 9 and the tapered wall 12 of the base 2 results in a wedge 13 of adhesive material being formed which tends to hold the mounting securely in place.

9 Claims, 3 Drawing Figures

CATSEYE MOUNTINGS

This invention is concerned with the construction of housings for mounting "catseyes" into road surfaces. The conventional form of "catseye" mounting has a generally square or oblong shape and the method of bedding a "catseye" mounting into a road surface comprises the steps of chiselling out a square or oblong hole of a size large enough to receive the "catseye" mounting, making good the base of the hole, and then fixing the "catseye" mounting into the hole with a suitable adhesive which will fill the gap between the "catseye" mounting and the hole edges.

The main problem with this method of fixing a "catseye" mounting into a road surface is that the hole chiselled out is almost certainly likely to be of an irregular shape and will give rise to a clearance gap between the edge of the hole and the "catseye" mounting which will vary around the perimeter of the mounting. A poorly formed hole can give rise to several problems. Thus small gaps may be left through which water could seep to cause cracking of the road surface due to freezing of the water in cold weather. More importantly, if the "catseye" mounting is not a snug fit within the hole, there is the possibility that, with use, the "catseye" mounting may rock loose under the impact of the wheels of traffic. Furthermore, the bedding method employed involves several steps and thus a fair amount of time is needed for the operation of bedding in of each "catseye" mounting.

It is an object of this invention to provide a "catseye" mounting which will alleviate or substantially eliminate the above problems.

Accordingly, this invention provides a mounting for a "catseye" comprising a housing providing a base of circular external cross-section and an internal cavity with mounting projections to hold in place the "catseye" rubber pad incorporating the reflecting studs.

The provision of a "catseye" mounting having a base of circular external cross-section means of course that it can be embedded in a hole which is also of circular cross-section. Such holes can readily be formed in a road surface by using a core drilling machine. Such a hole can have quite precise dimensions so that a very small clearance gap between the edge of the hole and the base of the "catseye" mounting can be assured. This results in a much more secure embedding of the "catseye" mounting into the road surface with adhesive, with much less possibility that the "catseye" mounting may rock loose. Furthermore, there are very clean edges to the wall of the hole so that there is much less risk of subsequent wear occurring of the road surface surrounding the "catseye" mounting.

In the preferred embodiment, the upper portion of the housing is formed with a rim of larger diameter than the circular base. This rim will cover over the edge of the hole receiving the circular base but can, if desired, be recessed intb the road surface as well by forming the top portion of the hole to a slightly larger diameter so as to receive the rim of the "catseye" mounting. It may also be of advantage to form the under-surface of the base so that it is dished inwardly so as to provide a better key with the adhesive material which will hold the "catseye" mounting in the hole and to provide space for a projecting surface at the base of the hole on which the "catseye" mounting may tend to rock. If the outer wall of the base of the "catseye" mounting tapers inwardly from the undersurface, then when an adhesive material is injected into the gap between the mounting and the hole, the adhesive material will form a wedge which tends to hold the mounting securely in place. Additionally or alternatively keying projections or recesses may be formed to extend from or into the circumferential outer wall and/or the undersurface of the base. The circumference projections could be rings or helices and the recesses could be helical or annular grooves. As an alternative, the projections could be elongated bars or fingers projecting outwardly from the sides of the base. These would be received in grooves radiating from the edge of the hole cut into the road surface and would provide added insurance against movement of the "catseye" mounting within the hole.

The invention also extends to a method of bedding a "catseye" mounting of this invention, as hereinbefore defined, into a road surface, which comprises drilling out a cylindrical core of the road surface to provide a hole which will receive the base of the "catseye" mounting with a small clearance, and fixing the base of the "catseye" mounting into the hole with a suitable adhesive material.

The adhesive material may be bitumen, or a resin-based adhesive, or concrete. It is of advantage to provide the "catseye" mounting with a filling aperture in its upper surface leading to an opening in the side wall adjacent the base, through which the adhesive may be injected.

The hole in the road surface itself may be formed additionally with recesses to act as a key for the adhesive material and/or to receive corresponding projections on the "catseye" mounting. One possibility is that the corresponding recesses and projections could provide a screw-thread whereby the "catseye" mounting may be screwed into position in the hole prior to fixing by the adhesive material.

The invention may be performed in various ways and a preferred embodiment thereof will now be described with reference to the accompanying drawings, in which.

Figure 1:
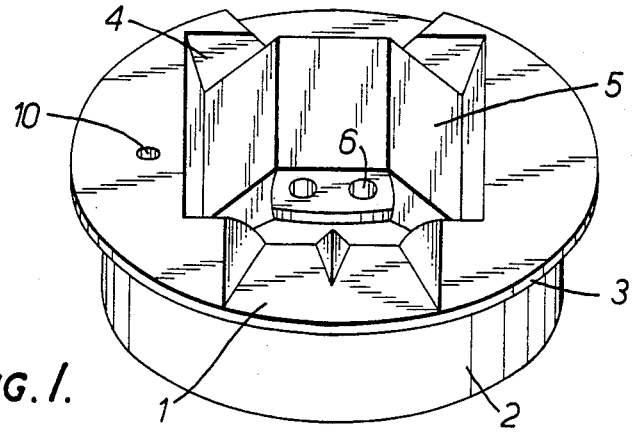
FIG. 1 is a perspective view from above of a "catseye" mounting constructed in accordance with this invention.
Figure 2:
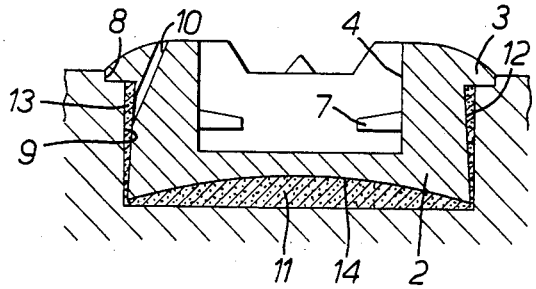
FIG. 2 is a cross-section of the "catseye" mounting of FIG. 1 shown fixed into a road surface.

The "catseye" mounting shown in FIGS. 1 and 2 comprises an upper portion 1 from which depends a base 2 of circular cross-section. The outer edge of the upper portion 1 provides a rim 3 of slightly larger radius than the base 2. A cavity 4 is formed within the "catseye" mounting which receives a rubber pad 5 of conventional design incorporating reflecting studs 6 and held in place by inwardly projecting flanges 7.

The "catseye" mounting will be fixed into a road surface in the following manner. Firstly a circular hole will be formed in the road surface by using a core drilling machine, the core so formed being knocked out with a cold chisel. The floor of the hole will then be made good if necessary. An upper portion of the core drilling shaft cuts a shallow recess 8 (FIG. 2) of a slightly larger radius than the main hole 9. The "catseye" mounting will then be dropped into the hole so that the rim 3 is received within the recess 8, the remaining space within the hole 9 being filled with a suitable adhesive material, such a bitumen, resin-based adhesive, or concrete. A passageway 10 passing through the "catseye" mounting can be used to inject the adhesive material into the space 11 and may with advantage be provided with a grease-nipple type device so that the adhesive material may be injected under pressure whilst the "catseye" mounting is held down. It will be seen that the side wall 12 of the base 2 of the "catseye" mounting is tapered (so that there is a clearance with respect to the wall surface of the hole 9 of 1 mm at the base of the hole and 2 mm near the top of the hole), thus producing a wedge 13 of adhesive material which tends to hold the "catseye" mounting down into the hole. The bottom surface 14 of the base 2 is dished as shown in FIG. 2.

Figure 3:
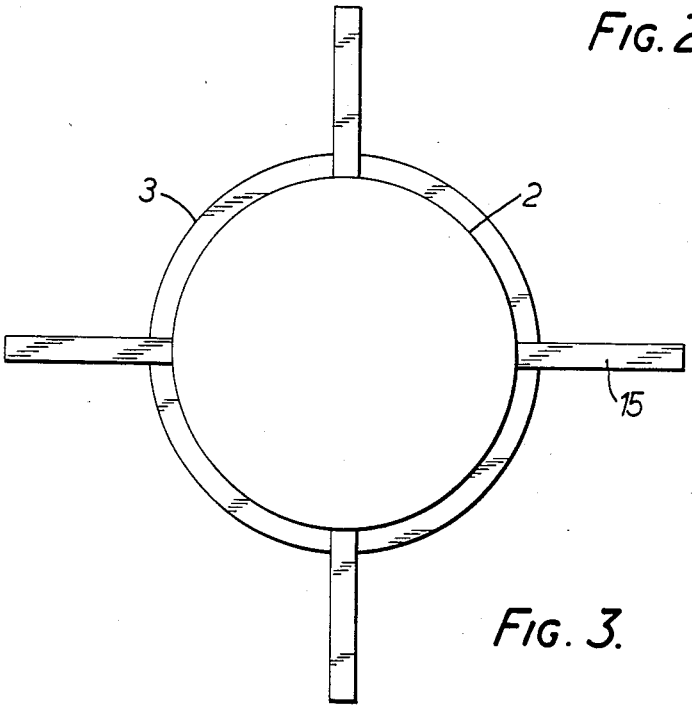
FIG. 3 is an underneath plan view of an alternative form of "catseye" mounting of the invention.

If desired, the external circular wall surface of the base 2 can be formed with projections, grooves, recesses, rings, or helices to provide added gripping surfaces for the adhesive material and similar formations may be created in the wall surface of the hole 9. FIG. 3 illustrates an arrangement whereby elongated fingers 15 are provided from the base 2. These will be received within correspondingly formed slits radiating outwardly from the hole 9 in the road surface which will be filled subsequently with adhesive material so as to hold the "catseye" mounting securely in place.

As an alternative to injecting adhesive material (or pre-filling the hole 9) the adhesive could also be applied simply by use of a brush to the "catseye" mounting 2 and/or the interior of the hole 9.

The "catseye" mounting comprising the parts 1 and 2 is formed from cast aluminium or iron or other robust metals and although it will be appreciated that other convenient materials and methods of forming may be used. One particular possibility is to form the mounting from a robust plastics material. This would have suitable characteristics, such as high impact and abrasion resistance, as well as resistance to ultra violet light which tends to degrade some plastics materials.

Also a mounting formed from plastics material would be of light weight compared with solid metal mountings. This is of advantage if the mounting should become displaced by a vehicle wheel (following deterioration of the road surface), as a lighter object is less likely to cause damage or injury. Even metal mountings can have their weight reduced removing some of the metal from the base portion 2, such as by forming it with scalloped recesses in the circumferential surface, without seriously affecting the strength of the mounting.

We claim:

1. A mounting for a reflective roadstud insert in the form of a rubber pad incorporating reflecting studs, the mounting comprising a housing defining an internal cavity, mounting projections extending inwardly of the side walls of the cavity to receive and hold the insert within the cavity, the housing also defining a base part of circular external cross-section, and a circular rim above the base part of larger diameter than the base part, and wherein the circumferential outer wall of the base part tapers outwardly down from below the circular rim.

2. A mounting according to claim 1 wherein keying formations are defined on the circumferential outer wall of the base part.

3. A mounting according to claim 2 wherein the keying formations on the circumferential outer wall of the base part are grooves.

4. A mounting according to claim 1 wherein the under-surface of the base is dished inwardly.

5. A mounting according to claim 2 wherein the keying formations are projections projecting outwardly from the sides of the base.

6. A mounting according to claim 1 provided with a filling aperture in its upper surface leading to an opening in the side wall of the base portion and through which adhesive may be injected.

7. A mounting according to claim 1 formed from iron, aluminum or other robust metal, or a robust plastics material.

8. A method of bedding into a road surface a mounting for a reflective roadstud insert in the form of a rubber pad incorporating reflecting studs, the mounting comprising a housing defining an internal cavity, mounting projections extending inwardly of the side walls of the cavity to receive and hold the insert within the cavity, the housing also defining a base part of circular external cross-section, and a circular rim above the base part of larger diameter than the base part, and wherein the circumferential outer wall of the base part tapers outwardly down from below the circular rim, the method comprising drilling out a cylindrical core of the road surface to provide a hole which will receive the base portion of the mounting with a small clearance, drilling the top portion of the hole to a larger radius so as to receive the rim of the mounting, and fixing the mounting into the hole by filling the space between the hole and the tapered base portion of the mounting with a suitable adhesive material.

9. A method according to claim 8 wherein the adhesive material is bitumen, or a resin-based adhesive, or concrete.

* * * * *